US005275366A

United States Patent [19]

Simmons

[11] Patent Number: 5,275,366

[45] Date of Patent: Jan. 4, 1994

[54] FIXTURE MOUNTING BRACKET AND ASSOCIATED FIXTURE ASSEMBLY

[75] Inventor: David G. Simmons, Sidney, Ohio

[73] Assignee: Aluminum Company of America, Pittsburgh, Pa.

[21] Appl. No.: 977,920

[22] Filed: Nov. 18, 1992

[51] Int. Cl.[5] ..... A47B 96/06

[52] U.S. Cl. ..... 248/205.1; 362/432

[58] Field of Search ..... 248/205.1; 362/432, 362/147; 52/27, 28, 38, 21

[56] References Cited

U.S. PATENT DOCUMENTS

| | | | |
|---|---|---|---|
| 3,500,600 | 3/1970 | Bagley, Sr. | 52/211 |
| 4,635,168 | 1/1987 | Crowley | 562/147 |
| 4,726,152 | 2/1988 | Vagedes et al. | 52/28 |
| 4,854,093 | 8/1989 | Kellom | 52/28 |
| 4,887,195 | 12/1989 | Donelan | 362/147 |
| 5,000,409 | 3/1991 | MacLeod et al. | 284/205.1 |

*Primary Examiner*—Ramon O. Ramirez

*Attorney, Agent, or Firm*—David V. Radack; Glenn E. Klepac

[57] ABSTRACT

A fixture mounting bracket having a mounting bracket body including a front wall and a back wall. At least a section of the back wall has a stepped configuration that conforms generally to the lapped profile of exterior siding. Disposed on at least a portion of the section of the back wall having the stepped configuration is a gasket. The gasket resists dirt and moisture from entering between the mounting bracket body and the siding. A fixture assembly is also disclosed.

19 Claims, 2 Drawing Sheets

FIXTURE MOUNTING BRACKET AND ASSOCIATED FIXTURE ASSEMBLY

BACKGROUND OF THE INVENTION

This invention relates to a fixture mounting bracket and an associated fixture assembly and more specifically, to a fixture mounting bracket that is adapted to be mounted on siding having a lapped profile, such as vinyl siding mounted to the exterior of a residential dwelling.

It is often desired to mount various devices to the exterior of a building having siding. These devices include light fixtures, doorbells, electrical outlets, water spigots and flagpole mounts. A problem arose, however, in mounting these devices to siding having a lapped profile because the mounting base of these devices is usually flat and thus did not conform to the lapped profile of the siding.

There have been proposed several mounting brackets that have attempted to solve this problem. U.S. Pat. No. 4,635,168 discloses a mounting bracket having a flat faceplate portion and an integral peripheral skirt portion. The skirt portion has free edges which are configured in a stepped arrangement to correspond substantially identically with the lapped profile of the siding upon which the bracket is mounted. In order to resist dirt and moisture from entering into the space between the bracket and the siding, the patent suggests caulking around the bracket. This, of course, requires that separate caulk be available and also an extra installation step, not to mention the messiness and unattractive appearance of the caulking.

U.S. Pat. No. 5,000,409 also discloses a mounting bracket for use on siding having a lapped profile. This mounting bracket has a free edge with an enlarged bead comprising an outer lip and an inner lip which together define a groove for receiving a caulking compound. The patent states that water is prevented from flowing into the space between the siding and the mounting bracket due to the presence of the bead. Once again, however, this mounting bracket teaches providing caulking and a separate caulking step.

Despite these prior art devices there remains the need for a mounting bracket which is easy to manufacture and install and which provides an attractive and aesthetically pleasing mounting bracket for mounting devices on siding having a lapped profile.

SUMMARY OF THE INVENTION

The invention disclosed and claimed herein fulfills the above described need. The fixture mounting bracket comprises a mounting bracket body including a front wall and a back wall, at least a section of the back wall having a stepped configuration that conforms generally to the lapped profile of the siding. Disposed on at least a portion of the section of the back wall having the stepped configuration is gasketing means. The gasketing means resists dirt and moisture from entering between the mounting bracket body and the siding.

The invention also provides a fixture mounting bracket including a front wall and a side wall extending generally perpendicularly from the front wall. The side wall terminates in a free edge having a stepped configuration that conforms generally to the lapped profile of the siding. Gasketing means is disposed on at least a portion of the free edge, whereby the gasketing means resists dirt and moisture from entering the space, if any, formed between the mounting bracket and the body.

A fixture assembly is also provided which includes the fixture mounting bracket of the invention having mounted thereon a fixture, such as a light fixture.

It is an object of the invention to provide a fixture mounting bracket which conforms to the lapped profile of siding on a building.

It is a further object of the invention to provide a fixture mounting bracket which resists dirt and moisture from entering into the space between the bracket and the siding.

It is yet another object of the invention to avoid the use of caulking in mounting a fixture mounting bracket to siding having a lapped profile.

It is still a further object of the invention to provide a fixture mounting bracket having gasketing means which is securely bonded thereto.

It is still yet another object of the invention to provide an efficient method of making a fixture mounting bracket having gasketing means bonded securely thereto.

These and other objects of the invention will be more fully understood from the following description of the invention with reference to the drawings appended hereto.

DETAILED DESCRIPTION

Figure 1:
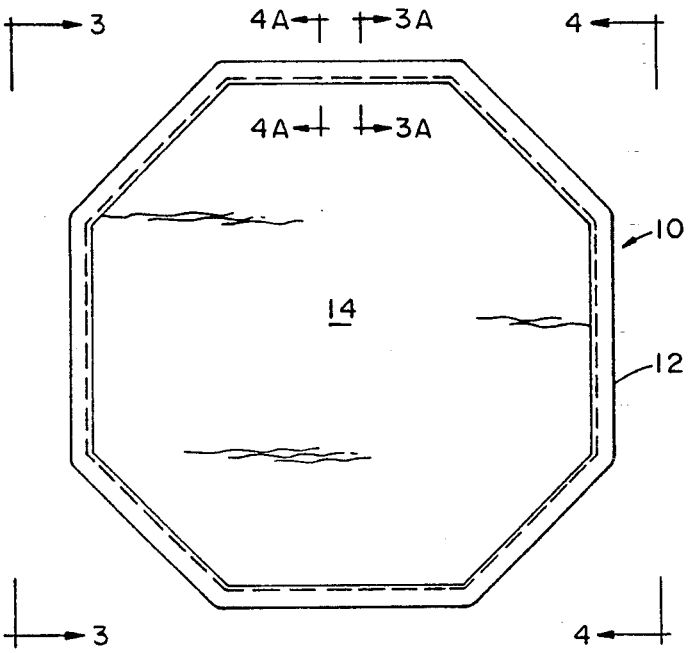
FIG. 1 is a front elevational view of a fixture mounting bracket embodying the invention.

Referring now to FIGS. 1–5, a fixture mounting bracket 10 in accordance with the invention is shown. The fixture mounting bracket 10 is shown having an octagonal shape, although it will be appreciated that other shapes and sizes can be used depending on the need and the aesthetic appearance desired. The fixture mounting bracket 10 is preferably composed of a plastic, for example, polyethylene such as that sold by Dow Chemical Company under the trade designation 10262N, and is made by an injection molding process as will be explained further below.

The fixture mounting bracket 10 has a fixture mounting bracket body 12 including a front wall 14 and a back wall 16. As can best be seen in FIG. 5, the fixture mounting bracket body 12 can include a side wall 20 extending generally perpendicularly from the back wall 16. The side wall 20 terminates in a free edge 22.

Figure 4:
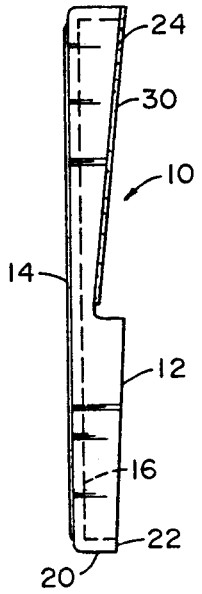
FIG. 4 is a right side elevational view of the fixture mounting bracket shown in FIG. 1.
Figure 2:
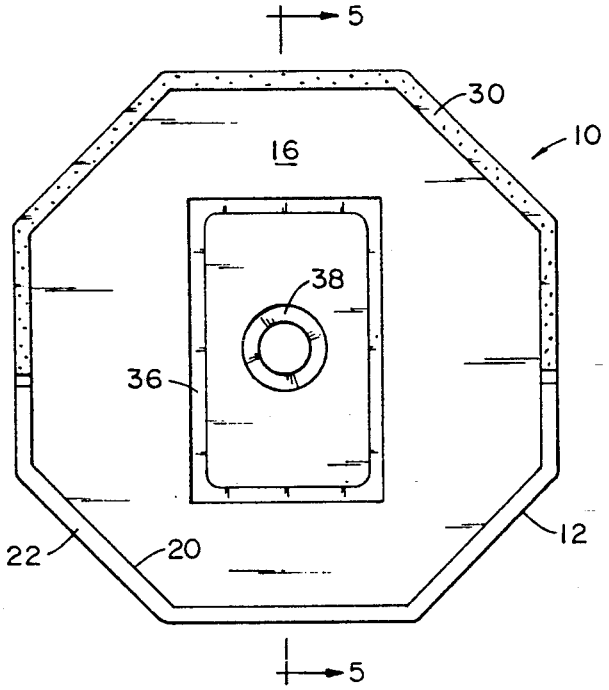
FIG. 2 is a back elevational view of the fixture mounting bracket shown in FIG. 1.
Figure 3:
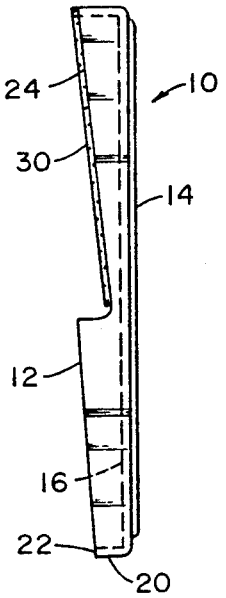
FIG. 3 is a left side elevational view of the fixture mounting bracket shown in FIG. 1.

Referring now to FIGS. 2–4, the free edge 22 has disposed along its upper portion 24 thereof resilient gasketing means 30. The resilient gasketing means 30 is securely bonded to the free edge 22 during the injection molding of the fixture mounting bracket body 12 as will be explained below. The gasketing means 30 is made of a foamed polymer material, for example, a vinyl/nitrile polymer such as that sold by Rubatex Corp., Bedford, Va. under the trade designation R-301-V. It will be appreciated that the gasketing means 30 is resilient and can provide an effective barrier to resist the entry of moisture and dirt into the fixture mounting bracket 10. The width and thickness of the gasketing means 30 can vary depending on the use of the fixture mounting bracket 10.

Figure 6:
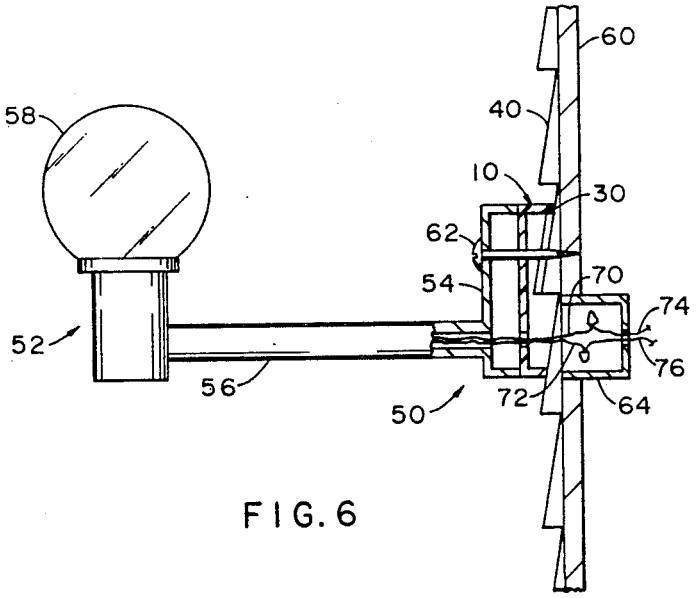
FIG. 6 is a side elevational view, partially in cross-section, showing a fixture assembly embodying the invention.

As can best be seen in FIG. 2, the gasketing means 30 is placed on the upper portion of the fixture mounting bracket body 12. This will allow escape of any moisture and dirt that does enter between the fixture mounting bracket 10 and the lapped profile siding 40 (FIG. 6). It will be appreciated, however, that the gasketing means 30 can be placed on the entire free edge 22 of the side wall 20. In that case, it would be desirable to provide a drain hole (not shown) in the bottom of the side wall 20 to allow escape of any moisture that does enter between the fixture mounting bracket 10 and the siding 40.

Figure 5:
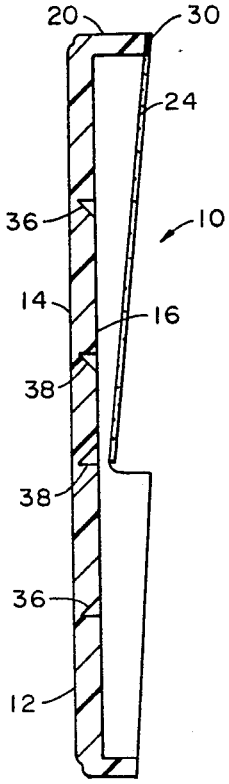
FIG. 5 is a cross-sectional view taken along line 5—5 of FIG. 2.

FIGS. 2 and 5 also show grooves 36 and 38 in the back wall 16 of the fixture mounting bracket body 12. These grooves 36 and 38 are used to facilitate cutting a desired aperture, such as a large rectangle using grooves 36 or a smaller circle using grooves 38, in the fixture mounting bracket body 12 so that, for example, conducting wires from a light fixture can be connected to an electricity source.

Referring now more particularly to FIGS. 3 and 4, it will be seen that the free edge 22 of the sidewall 20 of the fixture mounting bracket 10 has a stepped configuration. This stepped configuration will conform to the profile of lapped siding 40 on which the fixture mounting bracket 10 will be mounted.

Referring now to FIG. 6, a fixture assembly 50, consisting of a fixture, such as light fixture 52 including a base 54, support 56 and light 58 mounted to the fixture mounting bracket 10 is shown. The fixture assembly 50 is mounted to the lapped profile siding 40 which is connected to a vertical wall 60 of a building (not shown). The mounting of the fixture assembly to the building can be accomplished by mechanical fastening means such as screw 62. An electrical box 64 is provided in the vertical wall 60 to supply electricity to the fixture assembly 50. The wires 70 and 72 from the light 58 are connected to wires 74 and 76 emanating from the electrical box 64 in order to supply the light 58 with electricity.

As can be seen in FIG. 6, the resilient gasketing means 30 is in intimate surface-to-surface contact with the outer surface of the lapped profile siding 40. The gasketing means 30, because it is resilient, will conform to the surface of the lapped profile siding 40 and correct for any small gaps that may exist in the siding 40. Thus, a barrier will be provided so as to resist the entry of moisture and dirt into the space formed between the fixture mounting bracket 10 and the siding 40. This will, in turn, prolong the life of the fixture, as well as substantially lessen the incidence of shorting out the fixture due to water coming into contact with the electrical connections between the light and the wires in the electrical box 64.

The resilient gasketing means 30 eliminates the need to provide caulking in order to provide a barrier between the fixture mounting bracket 10 and the siding 40. There are several advantages to eliminating the need for caulking such as speeding installation time and providing an attractive, inconspicuous barrier.

As stated above, the fixture mounting bracket 10 is preferably made from plastic by an injection molding process. As is well known, injection molding involves providing a two piece mold in the form of the article to be produced. The molds are movable relative to each other. To produce the article, the molds are moved into position and molten plastic, formed by heating pellets of plastic materials in an extruder, is injected into the mold and allowed to solidify. The mold is then separated and the article is removed.

Figure 3A:
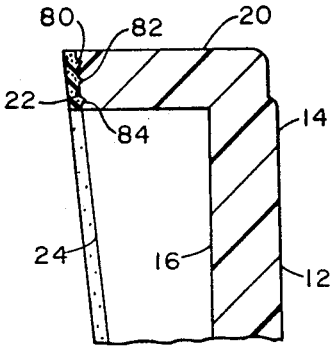
FIG. 3A is cross-sectional view taken along line 3A—3A of FIG. 1.
Figure 4A:
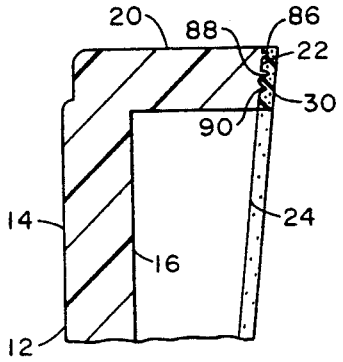
FIG. 4A is a cross-sectional view taken along line 4A—4A of FIG. 1.

The fixture mounting bracket 10 is made by placing the desired size piece of gasketing means 30 on one of the mold parts before moving the mold together. Once the mold parts are moved together, the molten plastic is injected into the mold to form the fixture mounting bracket body 12. As this is happening, the gasketing means 30 is securely bonded to the fixture mounting bracket body 12 due to the fact that portions of the gasketing means 30 is melted by the molten plastic which forms the fixture mounting bracket body 12. As can best be seen in FIGS. 3A and 4A, there is formed a secure bond between the fixture mounting bracket body 12 and the gasketing means 30 because the materials of each are partially intermixed during the injection molding process as indicated by areas 80, 82 and 84 on FIG. 3A and areas 86, 88 and 90 of FIG. 4A.

It will be appreciated that a fixture mounting bracket is provided which is easy to manufacture and install and which provides a barrier between the fixture mounting bracket and siding having a lapped profile without the use of caulking.

While the invention has been described in terms of preferred embodiments, the claims appended hereto are intended to encompass all embodiments which fall within the spirit of the invention.

I claim:

1. A fixture mounting bracket adapted to being mounted to siding having a lapped profile, said bracket comprising:

a mounting bracket body including a front wall and a back wall;

at least a section of said back wall having a stepped configuration that conforms generally to said lapped profile of said siding; and gasketing means composed of a foamed polymer material and disposed on at least a portion of said section of said back wall having said stepped configuration, whereby said gasketing means resists dirt and moisture from entering between said mounting bracket body and said siding.

2. The bracket of claim 1, wherein said mounting bracket body is formed with grooves that define areas suitable for being cut out of said mounting bracket body.

3. The bracket of claim 1, wherein said mounting bracket body is composed of plastic.

4. The bracket of claim 3, wherein said gasketing means is securely bonded to at least some portions of said mounting bracket body by the intermixing of said plastic and said foamed polymer material as said mounting bracket body is being formed by an injection molding process.

5. The bracket of claim 4, wherein said foamed polymer material is a vinyl/nitrile polymer.

6. The bracket of claim 1, wherein said mounting bracket body includes a side wall extending generally perpendicularly from said front wall;

said side wall terminates in a free edge which forms a portion of said back wall; and said gasketing means is disposed on said free edge.

7. The bracket of claim 1, wherein said gasketing means is disposed only on an uppermost portion of said mounting bracket body, whereby dirt and moisture that does enter into a space between said mounting bracket body and said siding can escape therefrom.

8. A fixture mounting bracket adapted to being mounted to siding having a lapped profile, said bracket comprising:

a mounting bracket body including a front wall and side wall extending generally perpendicularly from said front wall;

said side wall terminating in a free edge and having a stepped configuration that conforms generally to said lapped profile of said siding; and gasketing means composed of a resilient foamed polymer material and disposed on at least a portion of said free edge, whereby said gasketing means resists dirt and moisture from entering between said mounting bracket body and said siding.

9. The bracket of claim 8, wherein said mounting bracket body is composed of plastic.

10. The bracket of claim 9, wherein said gasketing means is securely bonded to at least some portions of said mounting bracket body by intermixing of said plastic and said resilient foamed polymer material as said mounting bracket body is being formed by an injection molding process.

11. The bracket of claim 10, wherein said foamed polymer material is vinyl/nitrile.

12. A fixture assembly for mounting on siding having a lapped profile, said assembly comprising a fixture mounting bracket including:

a mounting bracket body including a front wall and a back wall;

at least a section of said back wall having a stepped configuration that conforms generally to said lapped profile of said siding; and gasketing means composed of a resilient foamed polymer material and disposed on at least a portion of said section of said back wall having said stepped configuration; and fixture means mounted on said front wall.

13. The assembly of claim 12, wherein said mounting bracket body is formed with grooves that define areas adapted to being cut-out of said mounting bracket body.

14. The assembly of claim 12, wherein said fixture means is a light fixture.

15. The assembly of claim 12, wherein said fixture means is selected from the group consisting of a water spigot means, door bell means, and flagpole holder means.

16. The assembly of claim 12, wherein said mounting bracket body is composed of plastic.

17. The assembly of claim 16, wherein said gasketing means is securely bonded to said mounting bracket body as said mounting bracket body is being formed by an injection molding process.

18. The assembly of claim 17, wherein said foamed polymer material is vinyl/nitrile.

19. The assembly of claim 20, including mechanical fastening means for mounting said light fixture to said mounting bracket body and said siding.

* * * * *